US005431408A

United States Patent [19]

Adams

[11] Patent Number: 5,431,408

[45] Date of Patent: Jul. 11, 1995

[54] CARD GAME WITH TRAVELLING WILD CARD

[75] Inventor: William R. Adams, Las Vegas, Nev.

[73] Assignee: DD Stud, Inc., Las Vegas, Nev.

[21] Appl. No.: 311,781

[22] Filed: Sep. 23, 1994

[51] Int. Cl.[6] ..... A63F 1/00

[52] U.S. Cl. ..... 273/306; 273/292

[58] Field of Search ..... 273/292, 303, 306, 293

[56] References Cited

U.S. PATENT DOCUMENTS

| | | | |
|---|---|---|---|
| 1,738,902 | 12/1929 | Howard | 273/306 X |
| 2,639,922 | 5/1953 | Laycott | 273/306 |
| 2,687,306 | 8/1954 | Cheng | 273/306 X |
| 4,591,162 | 5/1986 | Fakhowry | 273/306 X |
| 5,282,633 | 2/1994 | Boylan et al. | 273/306 |
| 5,310,347 | 5/1994 | Brand | 273/306 X |

FOREIGN PATENT DOCUMENTS

| | | | |
|---|---|---|---|
| 9305855 | 4/1993 | WIPO | 273/306 |

*Primary Examiner*—William E. Stoll

*Attorney, Agent, or Firm*—Galgano & Burke

[57] ABSTRACT

The various embodiments of the present invention are directed to card-type games which provide a player who has received a wild card during one hand, with the opportunity to reserve that wild card for use in a subsequent hand. Therefore, the present invention provides a player with an opportunity to utilize a wild card when it is most advantageous for him to do so, i.e. when he will maximize his winning payout. One embodiment comprises a gaming device having an electronic touch-sensitive screen, another embodiment comprises a gaming device, while a still further embodiment comprises a game table.

11 Claims, 4 Drawing Sheets

CARD GAME WITH TRAVELLING WILD CARD

The present invention is directed to card games and, more particularly, to novel card games which provide a player with the opportunity to reserve a wild card from one hand for use in a subsequent hand.

BACKGROUND OF THE INVENTION

Games utilizingplaying cards are popular throughout the world. Many people get hours of enjoyment and relaxation from playing cards. In certain parts of the world, wagering adds an additional dimension of excitement to the game. Whether in "card room" games where one of the players who is not associated with the owner of the establishment acts as a banker or in a traditional "casino" game environment where an employee of the house acts as a banker, wagering adds excitement to many forms of card games.

Players involved in card games with wagering often enjoy new games with relatively simple rules that can readily be learned by a beginner or casual player. Players and casinos also enjoy games that can be played quickly.

Typical card games involve a dealer providing a plurality of cards to each player. Each player then gathers the cards and tries to form the best possible hand according to some pre-determined hierarchy of hand values. For example, a standard poker hierarchy is, in descending order, Royal Flush, Straight Flush, Four of a Kind, Full House, Flush, Three of a Kind, Two Pair, One Pair, and High Card. In some games, players are permitted to discard certain cards and receive new cards in an effort to form a better hand.

It is also common to designate one or more cards as "wild" cards which can have any one of a predetermined number of values at the option of the player(s) receiving such wild cards. In this manner, the designation of wild cards within a deck can significantly increase the chances of a player attaining a successful hand. In known games which utilize wild cards, players must use the wild card in the hand in which the wild card is received. Therefore, is a player has a card hand of low or no value, the wild card may not be sufficient to allow that player to form a winning hand. For example, if the payout schedule for a given game starts at a pair of jacks, and the player has the following hand: 2, 4, 5, 10 of different suits and a wild card, the best poker hand that the player could form would be a pair of 10's. This hand would not qualify for a winning payout.

It is therefore desirable to provide a card game which increases the players' excitement and enjoyment, as well as the level of player participation by providing a player with an opportunity to maximize the impact of receiving a wild card.

It would also be desirable to provide a novel card game readily adaptable to wagering which is relatively simple to learn for a new player and which can be played quickly.

It would also be desirable to provide a game which provides a player with opportunities to increase his winning payout by using a wild card, received during the play of one hand, with a subsequent hand when a newly formed hand will provide a particularly high winning payout.

SUMMARY OF THE INVENTION

The various embodiments of the present invention are directed to "card" games which provide a player who has received a wild card during one hand, with the opportunity to reserve that wild card for use in a subsequent hand. As used herein, the term "card game", is intended to include conventional table/board type games wherein one or more persons deals actual playing cards to one or more players, as well as any type of mechanical or electronic device which displays indicia of playing cards. Therefore, the present invention provides a player with an opportunity to utilize a wild card when it is most advantageous for him to do so, i.e. when he will maximize his winning payout.

One preferred embodiment of the present invention comprises a gaming device having an electronic touch-sensitive screen which is controlled, at least in part, by a player touching images on the screen.

Another embodiment of the present invention comprises a gaming device wherein input from a player is supplied to a device through actuation buttons.

A still further embodiment of the present invention comprises a game table designed for use by a dealer and a plurality of players. Along with conventional indicia on the game table including betting areas for each player, each player area is also provided with a reserve area wherein a player may place a wild card if that player decides not to use the wild card in the hand in which he receives the wild card and prefers to use the wild card in a later hand.

Each of the embodiments of the present invention provide one or more players with opportunities to maximize the beneficial effect of a wild card.

These and other embodiments are described in greater detail with reference to the drawings.

DETAILED DESCRIPTION

The various embodiments of the present invention increase the level of player input, increase the likelihood of a winning payout, maximize the amount of a winning payout, and increase the overall level of enjoyment to a card game which utilizes at least one wild card. The present invention achieves these desirable results by providing a player who receives a wild card during the play of one hand with the option of reserving that wild card for use in a subsequent hand.

While the various embodiments of the present invention are illustrated in conjunction with a game of five-card draw poker, the advantages of the present invention are equally applicable to a wide variety of other card games.

According to the illustrated embodiments, five cards are displayed to a player. The player has the opportunity to discard one or more of the cards and, if the player receives a wild card, to place that wild card in a reserve area for use with a later hand. To the extent that the player has discarded any cards or moved a wild card from his hand to a reserve area, the player is provided with replacement cards. A winning payout is then provided to either the player with the highest hand or to any players which have attained a winning hand as determined by a predetermined payout schedule.

According to one preferred embodiment of the present invention, a first plurality of cards which are displayed to a player are selected from a deck which does not include a wild card. In this manner, the game can be controlled so that the first plurality of cards which are displayed to a player are selected from a deck which does not include a wild card. In this manner, the game can be controlled so that the first plurality of cards displayed to a player never contains a wild card. The cards remaining after making the first display can then be reshuffled along with one or more wild cards to form a second collection of cards from which the player's remaining cards are displayed. Those skilled in the art will appreciate that the chances of displaying a wild card to a player can be controlled by controlling the number of cards in the collection, by controlling the number of wild cards added to the deck, as well as by keeping the wild cards out of the collection until a number of cards have been dealt.

Figure 1:
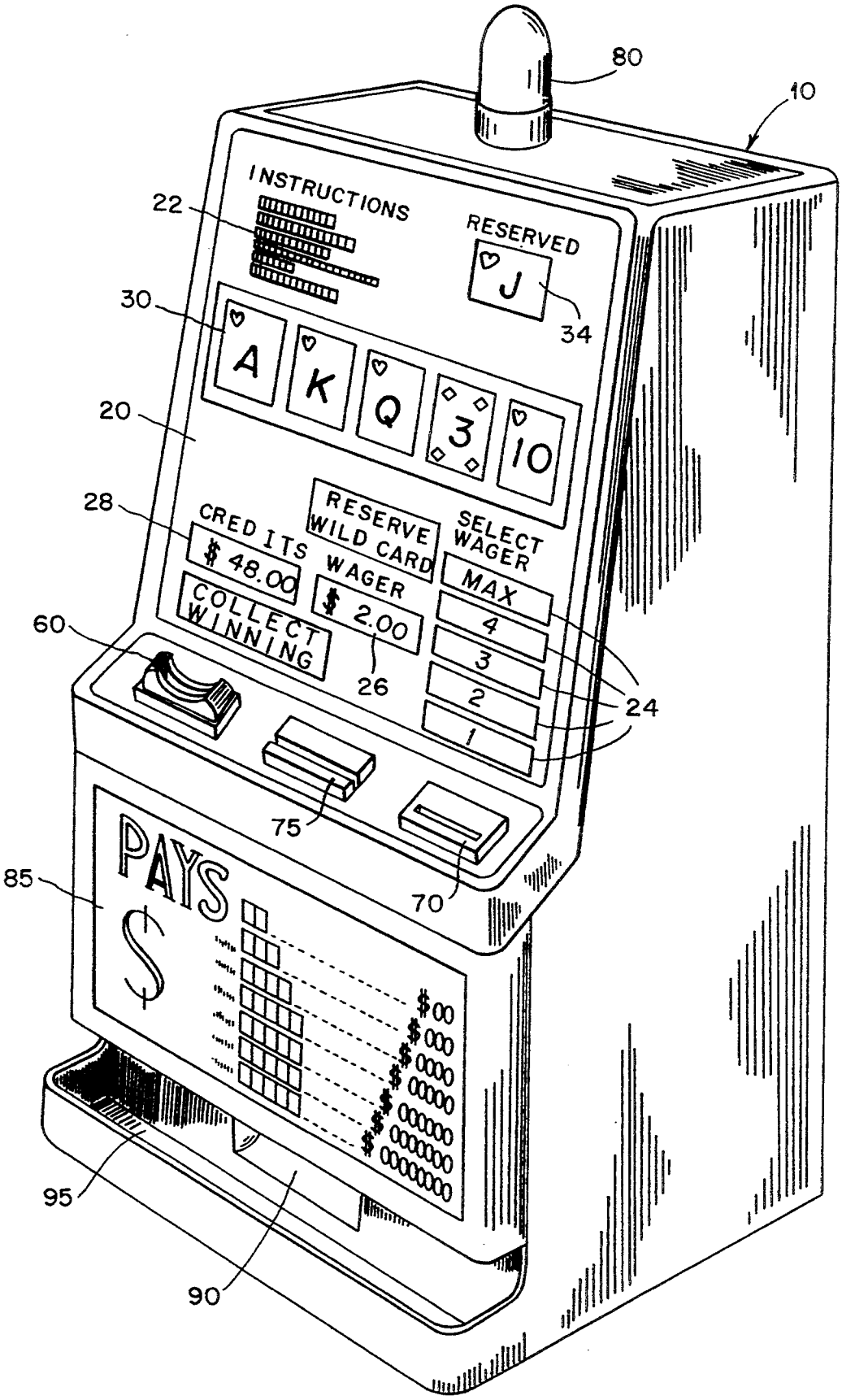
FIG. 1 illustrates a gaming device embodiment of the present invention comprising a touch screen.

FIG. 1 illustrates one embodiment of the present invention in the form of a gaming device 10 having a pressure-sensitive touch screen 20, a coin slot 60, a bill validator 70, a credit card receiver/terminal 75, flashing light 80, payout schedule 85, coin chute 90 and coin trough 95. This embodiment of the present invention can be activated by a player inserting an item of monetary value including coins, paper currency, tokens, or some form of credit indicator, such as a credit card. Suitable instructions are provided in instruction window 22 to guide a player through the initial steps necessary to start the game, as well as through subsequent steps. If a player has inserted more than the amount of the minimum wage, he will be required to designate the amount of his wager by touching the corresponding wager areas under the designation "SELECT WAGER". The amount wagered will then show up in wager window 26. If the player had inserted an amount greater than the amount wagered, his remaining credits will appear in credit window 28. Wagers for subsequent hands can then be automatically withdrawn from the player's credits in a manner which is now well known in the art.

After the player has selected his initial wager, a plurality of indicia of playing cards 30 are displayed on the screen. Following instructions and prompts provided in instruction window 22, the player may opt to discard one or more of the cards by simply touching the image of the card on screen 20. Alternatively, an actuator may be provided for this and other player input on a button panel. If the player receives a wild card, the player may also opt to reserve the wild card for use in a subsequent hand by touching the "RESERVE WILD CARD" area 32. When a player reserves a wild card, the player is provided with an image of the wild card in reserve area 34.

If the player has discarded any cards and/or reserved a wild card, replacement cards are provided to the player's hand and displayed in display area 30. If the resulting display comprises one of a predetermined plurality winning card hands, the player is provided with a winning payout. Particularly high winning payouts may be accompanied by discernable signals such as a flashing light 28 and audible sirens from a speaker (not shown). The amount that the player has won is then preferably added to the amount shown in the "CREDITS" window 28.

Figure 2:
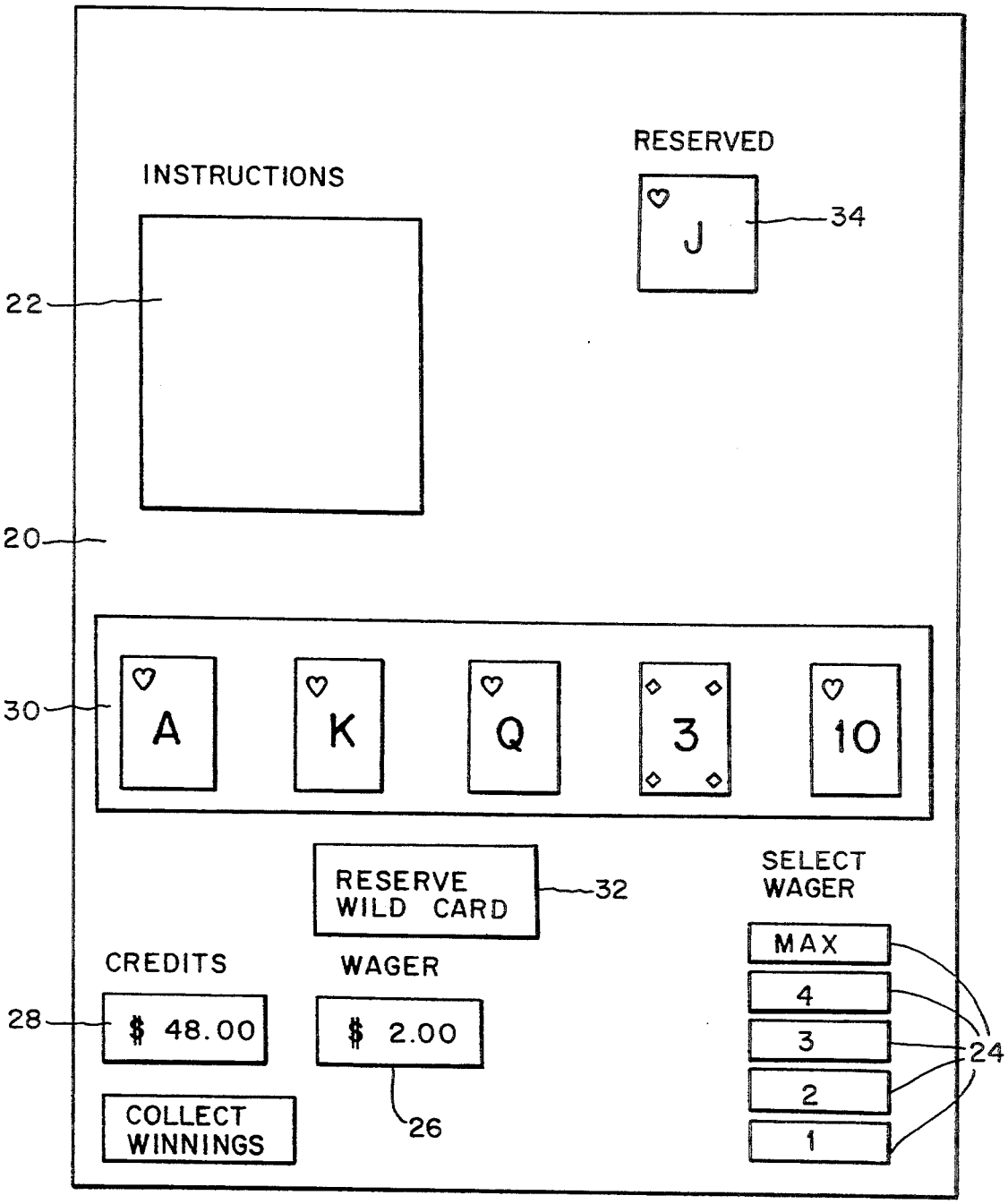
FIG. 2 illustrates a touch screen used with the embodiment of FIG. 1.

As an example, the hand shown in card display area 30 of FIG. 2 indicates a hand in which a player would want to utilize a wild card previously held in RESERVE area 34. Those familiar with poker will appreciate that by replacing the 3 of diamonds with the wild card, the player will have attained a Royal Flush and, typically, a large payout.

As a further enhancement to the excitement provided by the games of the present invention, it is also within the scope of the present invention to provide a double payout when the player uses a wild card.

Since the present invention can be played with a wide variety of card games, the winning payouts for a winning hand can vary widely. As an example, with the five-card draw poker game described above, the payout schedule could be as follows:

PAYOUT SCHEDULE

Figure 3:
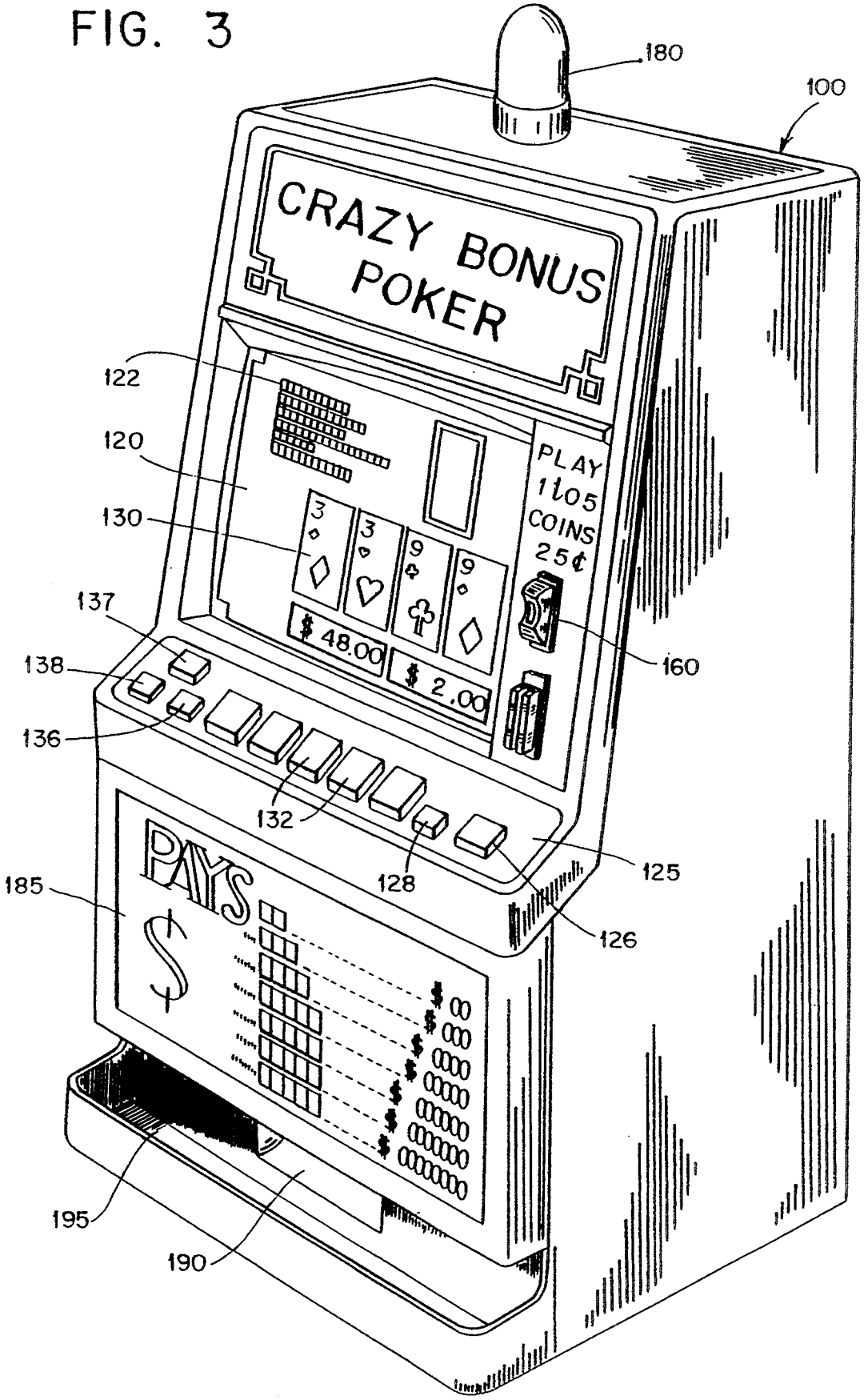
FIG. 3 illustrates a gaming device of another embodiment of the present invention.

Royal Flush
Straight Flush
Four Of A Kind
Full House
Flush
Three Of A Kind
Two Pair
Pair of Jacks or better An alternative embodiment of the present invention is illustrated in FIG. 3 in the form of a gaming device. This embodiment of the present invention differs from the embodiment illustrated in FIGS. 1 and 2 in that decisions are input to the machine by the player depressing one or more buttons on a button panel 125. Button panel 125 comprises a "DEAL/DRAW" button 126, "BET ONE" button 128, a plurality of hold buttons 132, a "RESERVE WILD CARD" button 133, a "CASH/CREDIT" button 136, a change button 137 and a "COLLECT WINNINGS" button 138. According to this embodiment of the present invention, after a player has input monetary value into coin slot 160 or bill validator 170, he can select the amount that he wants to wager on the present hand by depressing "BET ONE" button 128 the number of times needed to properly show his wager in wager window 127 on screen 120. The remaining portion of the player's credits will be indicated in credit window 129. The player then depresses "DEAL/DRAW" button 126 in order to receive his first plurality of cards. The player may then select which cards he wants to hold by depressing corresponding "HOLD" buttons 132 which are most preferably aligned with the indicia of playing cards 130 appearing on screen 120. If the player has received a wild card that he wishes to reserve for use in a subsequent hand, the player then depresses "RESERVE" button 133 which will move the wild card up into wild card reserve area 134 on screen 120.

When the player has made his selection regarding which cards to hold and/or reserve, he must then again press "DEAL/DRAW" button 126 in order to receive replacement cards. According to this illustrated embodiment, after the player has received any necessary replacement cards the gaming device 100 automatically determines whether the player has received a winning hand and, if he has, provides a winning payout according to payout schedule 185 and increases the player's credits shown in credit window 129 accordingly. When a player has finished playing and wishes to withdraw any credits shown in credit window 129, the player can simply depress "COLLECT WINNINGS" button 138 in order to receive his money and/or credits. As illustrated, button panel 125 is also provided with "CHANGE" button 137 which will permit a player to receive change from a casino attendant as needed.

Figure 4:
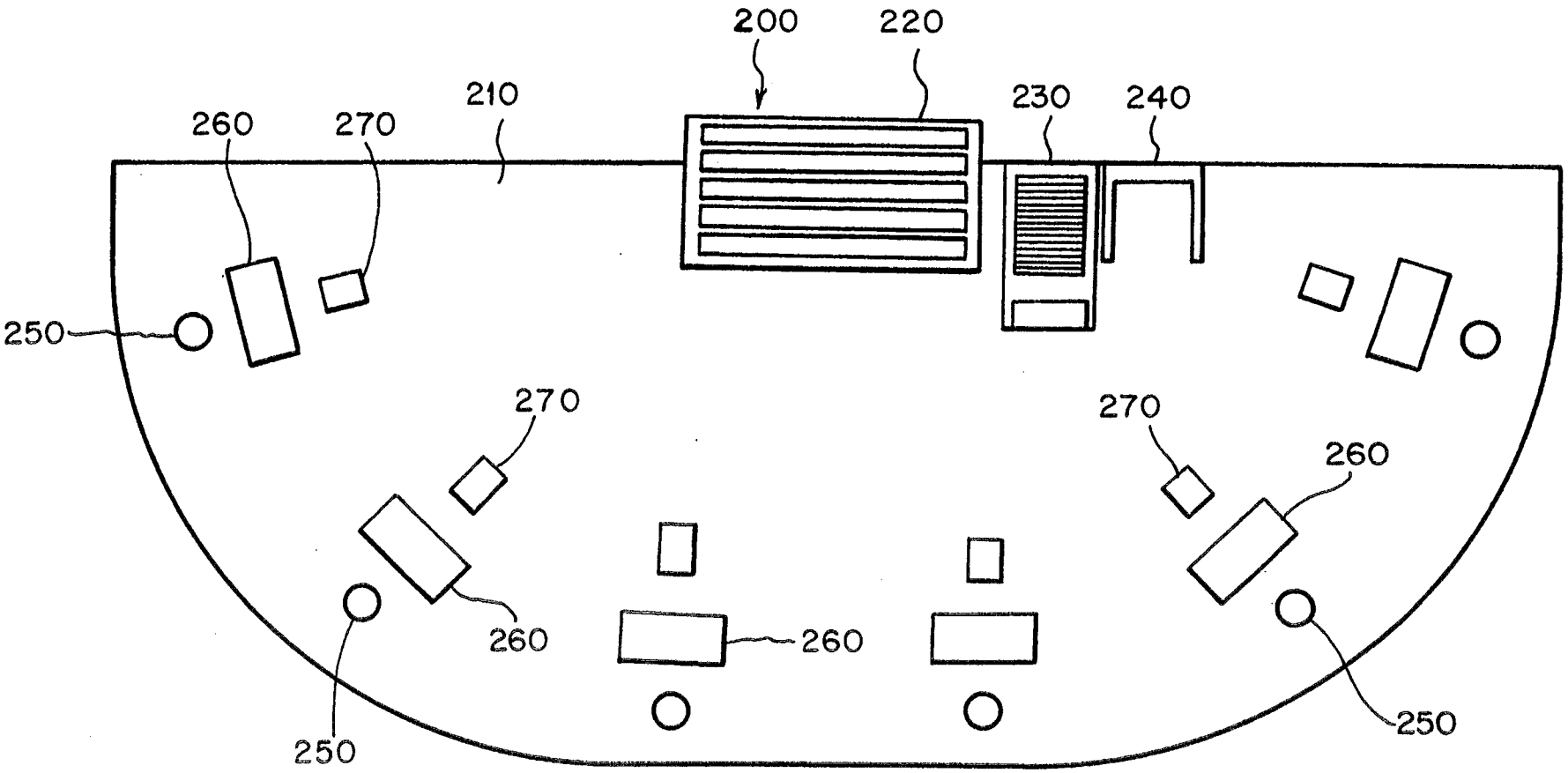
FIG. 4 illustrates a board game embodiment of the present invention.

Another embodiment of the present invention is illustrated in FIG. 4 wherein a gaming table 200 is provided with a playing surface 210, chip rack 220, card shoe 230 and discard tray 240. A plurality of player stations are located around the playing surface. According to this embodiment of the present invention, each playing area comprises a wager area 250, a card area 260 and a wild card reserve area 270. According to this embodiment of the present invention, when a player wishes to reserve a wild card for use in a subsequent hand, the reserved wild card is placed in a "wild card reserve area" 270.

While the present embodiments have been described as providing a player with an option of reserving a wild card when that player receives such a wild card during the initial deal, the various embodiments of the present invention can also provide a player with the option reserving a wild card for use in a subsequent hand even if that player receives one or more wild cards as replacement cards for those which he has originally discarded. Furthermore, a player may be provided with the option of retrieving a card from a wild card reserve area after he has received his replacement card(s).

According to another preferred embodiment of the present invention, the player may reserve a wild card for use in a later hand if the player receives the wild card in his initially dealt cards or as a replacement card.

The present invention is readily adapted for use with a wide variety of games including black jack, many forms of poker, video keno, video bingo, video slot and/or a stepper slot.

What is claimed is:

1. A method of playing a card game comprising the steps of:

designating at least one card as a travelling wild card;

displaying a plurality of indicia of playing cards to at least one player which indicia form at least a partial card hand;

during the play of said at least partial card hand, providing said at least one player with the option of reserving said travelling wild card for use in a subsequent hand if said at least one player has been displayed a travelling wild card for use in said at least partial card hand.

2. A method of playing a card game accord to claim 1 wherein said at least one player receives a replacement card if said at least one player decided to reserve said travelling wild card for use in a subsequent hand.

3. A method off playing a card game according to claim 2 wherein said step of displaying a plurality of indicia of playing cards comprises:

displaying at least one indicia of a playing card selected from a first collection of card indicia which does not comprise a travelling wild card; and displaying at least one additional indicia of a playing card selected from a second collection of card indicia which comprises a travelling wild card.

4. A method of playing a card game according to claim 3 wherein said card indicia are randomly selected.

5. A method of playing a card game according to claim 3 wherein said second collection comprises indicia from said first collection which were not already displayed and at least one indicia of a travelling wild card.

6. A method of playing a card game according to claim 1 wherein said step of displaying a plurality of indicia of playing cards comprises electronically generating an image of a playing card on a screen.

7. A method of playing a card game according to claim 6 wherein said screen is a pressure sensitive touch screen.

8. A method of playing a card game according to claim 1 wherein said step of displaying a plurality of indicia of playing cards comprises displaying a plurality of playing cards on a playing surface.

9. A method of playing a card game comprising the steps of:

designating at least one card as a wild card;

displaying a plurality of indicia of playing cards to at least one player which indicia form at least a partial card hand and which are randomly selected from a first collection of cards which do not comprise said wild card;

displaying at least one additional indicia of playing cards to said at least one player, which additional indicia of playing cards are randomly selected from a second collection of cards which comprise at least one of said wild cards;

during the play of said at least partial card hand, providing said at least one player with the option of reserving said wild card for use in a subsequent hand if said at least one player has been displayed a travelling wild card for use in said at least partial card hand.

10. A method of playing a card game according to claim 9 wherein said step of displaying a plurality of indicia of playing cards comprises electronically generating an image of a playing card on a screen.

11. A method of playing a card game according to claim 9 wherein said step of displaying a plurality of indicia of playing cards comprises displaying a plurality of playing cards on a playing surface.

* * * * *